US006494818B1

(12) United States Patent
Richmond

(10) Patent No.: US 6,494,818 B1
(45) Date of Patent: Dec. 17, 2002

(54) EXERCISE UNIT

(75) Inventor: David J. Richmond, Los Angeles, CA (US)

(73) Assignee: Modern Media, Los Angeles, CA (US)

( * ) Notice: Subject to any disclaimer, the term of this patent is extended or adjusted under 35 U.S.C. 154(b) by 155 days.

(21) Appl. No.: 08/540,175

(22) Filed: Oct. 6, 1995

(51) Int. Cl.[7] ..... A63B 21/02
(52) U.S. Cl. ..... 482/121
(58) Field of Search ..... 482/121, 122, 482/124, 125, 79, 907

(56) References Cited

U.S. PATENT DOCUMENTS 4,735,412 A * 4/1988 Prsala ..... 482/125
5,514,058 A * 5/1996 Buoni et al. ..... 482/125

* cited by examiner

*Primary Examiner*—Stephen R. Crow
(74) *Attorney, Agent, or Firm*—Fulwider Patton, et al.; Ellsworth R. Roston

(57) ABSTRACT

A foot rest made from a suitable material (e.g. a polyolefin) may have, in cross section, a tear drop configuration defined by a progressively increasing width or may have a cylindrical shape in cross section. An aperture is provided through the foot rest and a hollow rod is extended through the aperture. In one embodiment, a stretchable member made from a suitable material such as a latex extends through the hollow rod closed loop. The user disposes the stretchable member around his thighs and feet and then reclines on a floor with the user's back on the floor. The user then rests his feet on the floor against the foot rest while reclining. The user then alternately arches the user's back upwardly to stretch the stretchable member and collapses the user's back against the floor to release such stretching. In another embodiment, a belt in the form of a first closed loop is attached to the opposite ends of a stretchable member to define with the rod and the stretchable member a second closed loop larger than the first closed loop. The belt may envelope the user's waist. The second closed loop extends between the user's waist and the bottom of the user's feet. The user then disposes both feet on the foot rest and alternately rises from a crouched position to a substantially upright position to stretch the stretchable member and then bends the user's knees to the crouched position to relieve any stretching of the stretchable member.

19 Claims, 2 Drawing Sheets

EXERCISE UNIT

This invention relates to an exercise unit. More particularly, the invention relates to an exercise unit which includes a minimal number of parts and which is light in weight and compact and which is efficient in exercising the user's muscles.

BACKGROUND OF THE INVENTION

Exercise units are now proliferating in view of the public's interest in providing sound and healthy bodies and in enhancing visual appearances. As the exercise units proliferate, they become increasingly heavy and complex. They also become increasingly expensive and immobile. Because of these factors, there is a tendency for the public to become increasingly wary of the claims made by the marketers of the exercise units concerning the benefits and advantages of such exercise units.

This invention provides an exercise unit which is light in weight and compact. It is also highly mobile so that it can be conveniently packed in a suitcase by a business person while such business person is travelling. It includes a minimal number of parts and is inexpensive. It is primarily used to exercise the muscles in the lower part of the user's body. Even though it is light, compact, mobile and relatively simple in construction and operation, it still operates efficiently in exercising the user's muscles.

BRIEF DESCRIPTION OF THE INVENTION

In one embodiment of the invention, a foot rest made from a suitable material such as a polyolefin may have a tear drop configuration defined by a progressively increasing width or may have a cylindrical shape in cross section. An aperture is provided through the foot rest and a hollow rod is extended through the aperture.

In one embodiment, a stretchable member made from a suitable material such as a latex extends through the hollow rod in a closed loop. The user disposes the stretchable member around his thighs and feet and then reclines on a floor with the user's back on the floor. The user then rests his feet on the floor against the foot rest while reclining with his back on the floor. The user then alternately arches the user's back upwardly to stretch the stretchable member and collapses the user's back against the floor to release such stretching.

In another embodiment, a belt in the form of a first closed loop is attached to the opposite ends of a stretchable member to define with the rod and the stretchable member a second closed loop larger than the first closed loop. The belt may envelope the user's waist. The stretchable member extends between the user's waist and the bottom of the user's feet. The user disposes both feet on the foot rest and alternately rises to a substantially upright position from a crouching portion to stretch the stretchable member and then bends the user's knees to relieve any stretching of the stretchable member.

Figure 1:
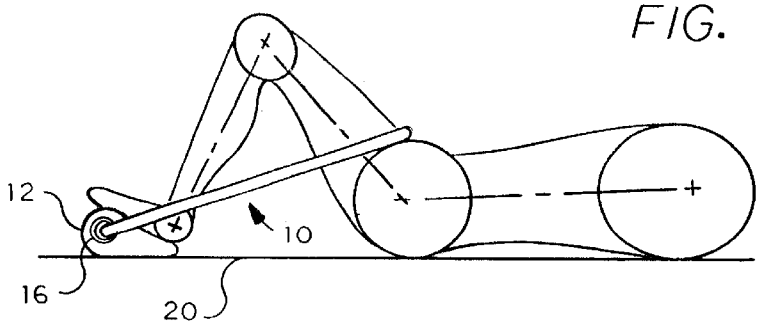
FIG. 1 is a schematical elevational view of an exercise unit constituting a first embodiment of the invention and shows the exercise unit between the user's feet and thighs with the user lying on the floor with his back on the floor.
Figure 2:
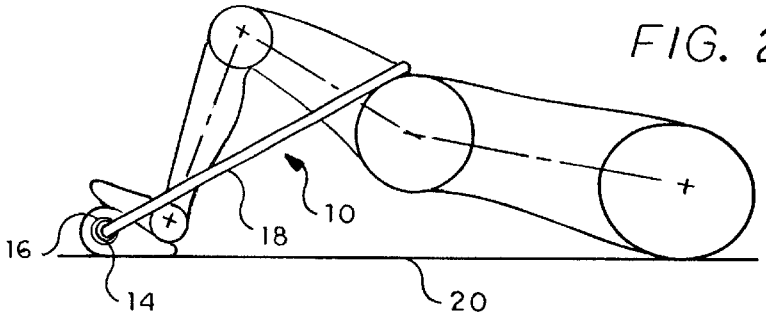
FIG. 2 is a view similar to that shown in FIG. 1 but with the user's back arched upwardly from the floor to stretch a member in the exercise unit.

One embodiment of an exercise unit is shown in FIGS. 1 and 2 and is generally indicated at 10. The exercise unit includes a foot rest 12 preferably having a substantially tear drop configuration in section. The foot rest 12 may be made from a suitable material such as a polyolefin. This causes the foot rest 12 to be relatively rigid and to be non-stretchable. The tear drop configuration provides the foot rest 12 with an increasing thickness at progressive positions along the length of the foot rest. At a position near the thick end of the foot rest 12, an aperture 14 extends through the foot rest. Although the footrest 12 is shown as preferably having a tear drop configuration in section, it will be appreciated that the foot rest may have other configurations in section. For example, the foot rest 12 may have an annular configuration in section.

A hollow rod 16 extends through the aperture 14 in the foot rest 12. A member 18 made from a stretchable material such as a latex has a first portion extending through the hollow rod 16 and has a second portion disposed outside of the aperture 14 and defining a closed loop with the portion in the aperture. The member 18 is the only stretchable member in the embodiment of the foot rest shown in FIGS. 1 and 2. As shown in FIG. 1, the foot rest 12 is disposed on the ground such that the thick end of the foot rest is disposed away from the user. This causes the foot rest 12 to be inclined and the ball and heel portions of the user's feet to be disposed on the foot rest when the user is lying on a floor 20 with the user's back disposed on the floor.

The user then bends the user's legs and disposes the member 18 so that the member rests on the user's thighs and envelopes the user's feet. This is shown in FIG. 1. The user then arches the user's back upwardly as shown in FIG. 2 while maintaining the user's feet firmly planted on the foot rest 12. This causes the member 18 to become stretched. As a result, the user has to exercise the user's leg muscles to stretch the member 18.

When the user has arched the user's back to the position schematically shown in FIG. 2, the user returns the user's back to the position against the floor 20 as shown in FIG. 1. This causes the constraint on the stretchable member 18 to become released. By moving the user's body alternately between the positions shown in FIGS. 1 and 2, the user is able to provide an efficient exercise of the user's back and leg muscles.

Figure 3:
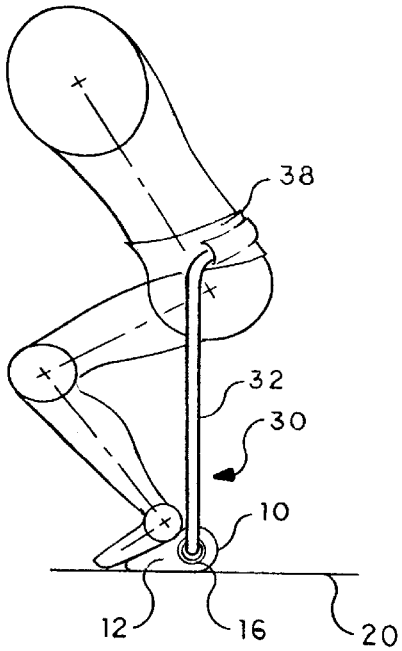
FIG. 3 is a schematic elevational view of an exercise unit constituting a second embodiment and shows the exercise unit wrapped around the user's waist and extending to the position adjacent the user's feet with the user in a crouched position on the floor.
Figure 4:
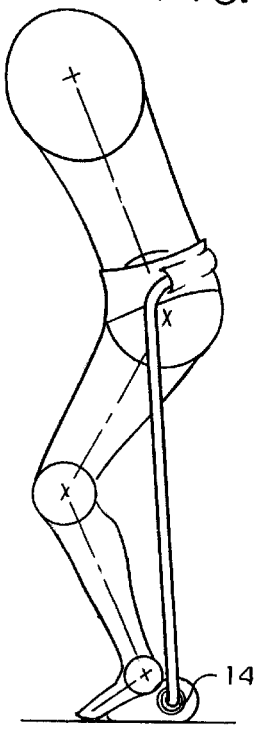
FIG. 4 is a view similar to that shown in FIG. 3 but with the user in a substantially upright position.

FIGS. 3 and 4 illustrate an exercise unit, generally at 30, constituting a second embodiment of the invention. The embodiment 30 is similar to the embodiment 10 in the inclusion of the foot rest 12 and the rod 16 extending through the aperture 14 in the foot rest. It is also substantially similar to the embodiment 10 in the disposition of a stretchable member 32 through the aperture 14 in the rod 16. However, the opposite ends of the stretchable member 32 are in turn attached to a member 38 forming a closed loop. The attachment of the stretchable member 32 to the member 38 is at the opposite ends of the closed loop. The member 38 may also be made from a stretchable material such as latex.

When the user desires to use the exercise unit 30, the user disposes the member 38 around the user's waist and stands on the floor 20 with the soles of the user's feet on the foot rest 12. The user then alternates between a crouching portion as shown in FIG. 3 and a substantially upright portion as shown in FIG. 4. When the user raises the user's body to substantially the upright position, the user has to work against the constraint of the stretchable member 32 by stretching the member. This constraint is relaxed when the user again returns to the crouching position. In this way, the user exercises the muscles of the user's legs. The degree of exercise can be controlled by adjusting the length of the stretchable member 32.

Figure 5:
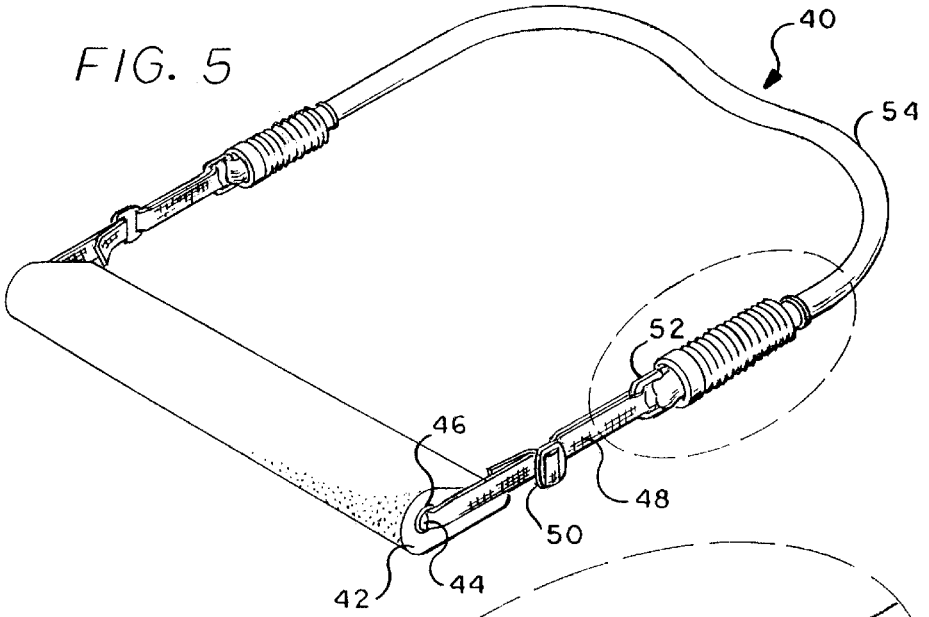
FIG. 5 is a perspective view of an exercise unit similar to that shown in FIGS. 1 and 2 but with a greater amount of specificity than that shown in FIGS. 1 and 2.
Figure 6:
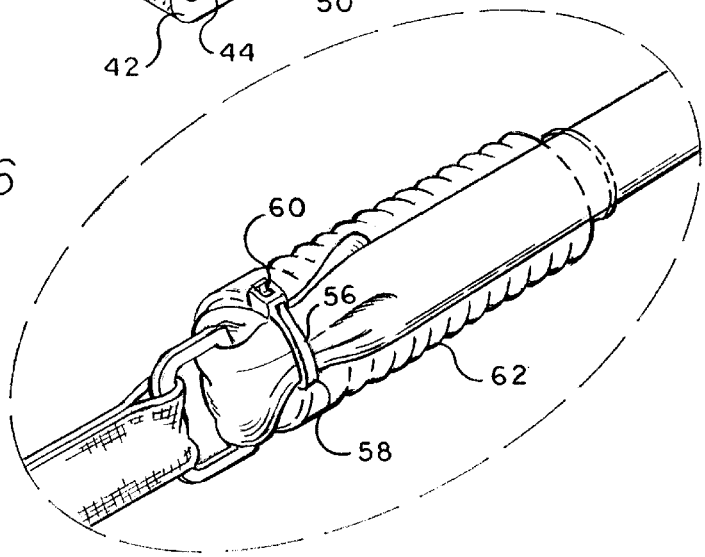
FIG. 6 is an enlarged fragmentary perspective view of a portion of the embodiment shown in FIG. 5.

FIGS. 5 and 6 show a preferred embodiment of the invention. This embodiment is generally indicated at 40. The embodiment 40 includes a foot rest 42 with a tear drop or annular configuration in section and with an aperture 44 near the thick end of the foot rest. A hollow rod 46 extends through the aperture 44. A strap 48 preferably made from a woven fabric material extends through the hollow rod 46.

The strap 48 is extended through tri-glides 50 at the opposite ends of the strap and then through rings 52 near the ends of the strap. The strap may then be folded back upon itself at its opposite ends and is again extended through the tri-glides 50. In this way, the length of the strap 48 between the rod 46 and each of the rings 50 may be adjusted by the user. The tri-glide 50 and the ring 52 are known in the art. The ring 52 may preferably have a D-shaped configuration.

A stretchable member 54 corresponding to the stretchable member 18 in FIGS. 1 and 2 is wrapped around the D-shaped portion of each of the rings 52. The stretchable member 54 may be provided with a hollow configuration and may be made from a suitable material such as a latex. The wrapped portion of the stretchable member 54 may be clamped to the rings 52 as by wire-tie generally indicated at 56. Each of the wire-ties 56 may include an open-ended loop 58 with the open ends of the loop extending through a clasp 60. A bellows 62 on the stretchable member 52 may be disposed within the wire-tie 56.

Figure 7:
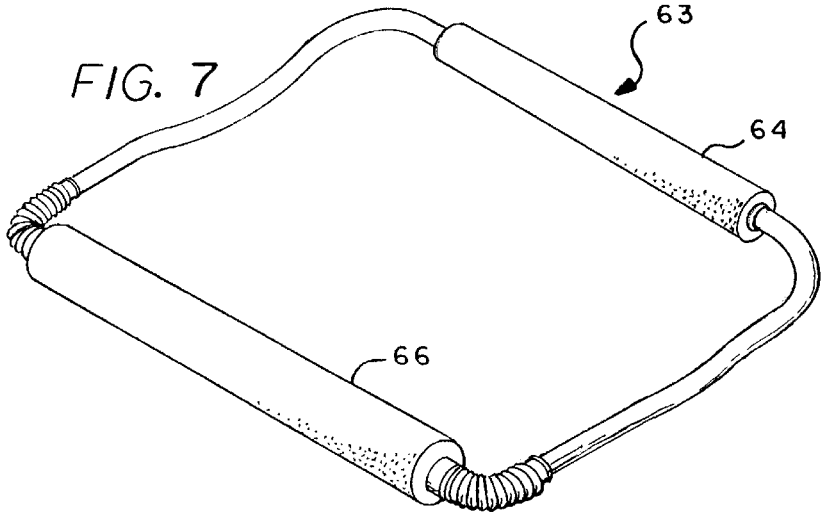
FIG. 7 is a perspective view, similar to that shown in FIG. 5, of another embodiment of the invention.

FIG. 7 is a schematic perspective view of another embodiment, generally indicated at 63, of the invention. In this embodiment, a handle 64 is disposed on the stretchable member 54 to enhance the comfort to the user. A footrest 66 with an annular configuration in section is included in the embodiment of FIG. 7 to show that the footrest may have other than a tear drop configuration in section. The embodiment shown in FIG. 7 is simplified relative to the embodiment shown in FIGS. 5 and 6 in that it eliminates the strap 48 and the tri-glide 50.

The exercise unit disclosed above and shown in the drawings has certain important advantages. It is light in weight, simple in construction and portable. All of these advantages allow the user to carry the exercise unit in a suitcase with the user's clothes in a minimal amount of space when the user is travelling. In spite of its simple construction and light weight, the exercise unit provides for an efficient exercise of a number of different muscles in a user's body. Furthermore, the inclusion of the foot rest provides comfort to the user when the user is exercising.

The exercise unit also provides for an adjustable tension in the stretchable member 54 in FIGS. 5 and 6 (and in the member 18 in FIGS. 1 and 2 and in the member 32 in FIGS. 3 and 4) when the member is stretched. This results from the adjustments capable of being provided in the lengths of the strap 48 as by the inclusion of the tri-glides 50.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

What is claimed is:

1. In combination in an exercise unit, a foot rest, and a stretchable member having a first portion coupled to the foot rest at opposite ends of the foot rest and having a second portion disposed outside of the foot rest and defining a continuous and closed loop with the first portion of the stretchable member, the foot rest having a tear drop configuration to facilitate the disposition of the feet of the user on the foot rest.

2. In combination in an exercise unit, a foot rest, and a stretchable member having a first portion coupled to the foot rest at opposite ends of the foot rest and having a second portion disposed outside of the foot rest and defining a continuous and closed loop with the first portion of the stretchable member, the foot rest having an aperture extending through the foot rest and a hollow rod extending through the aperture and the stretchable member having a portion extending through the hollow rod and having another portion disposed outside of the hollow rod and defining a continuous and closed loop with the portion extending through the hollow rod.

3. In combination in an exercise unit, a foot rest, and stretchable means coupled to the foot rest at opposite ends of the foot rest and defining a closed loop with the foot rest, the foot rest having an aperture extending through the foot rest and a hollow rod extending through the aperture and the stretchable member having a portion extending through the hollow rod and having another portion disposed outside of the hollow rod and defining a closed loop with the portion extending through the hollow rod, the foot rest having a tear drop configuration in section to facilitate the disposition of the feet of the user on the foot rest with the knees of the user bent, the tear drop configuration of the foot rest having a wide end, the aperture being disposed at the wide end of the tear drop configuration of the foot rest.

4. In combination in an exercise unit for use by a user, a foot rest for supporting the feet of the user, an aperture in the foot rest, a hollow rod extending through the aperture, a stretchable member having a portion extending through the hollow rod and a portion disposed outside of the hollow rod, the first and second portions defining a continuous and closed loop for the production of a constraint on the stretchable member when the stretchable member is stretched, the foot rest being constructed to support the user's feet and the stretchable member being constructed to be disposed around a portion of the user's body displaced from the user's feet to become constrained, and to become relieved of the constraint, by the alternate adoption by the user of first and second positions of the user's body.

5. In a combination as set forth in claim 4, the stretchable means including a stretchable member and a strap attached to the stretchable member at the opposite ends of the stretchable member and extending through the rod.

6. In a combination as set forth in claim 5, the strap being adjustable in length.

7. In a combination as set forth in claim 6, a ring, the strap extending through the ring and being folded back upon itself after extending through the ring and being clamped in the folded-back relationship, and the stretchable member extending through the ring and being folded back upon itself after extending through the ring and being clamped in the folded-back relationship.

8. In a combination as set forth in claim 7, means covering the stretchable member at the position of the clamping of the stretchable member.

9. In combination in an exercise unit, a foot rest, and a stretchable member having a one-piece construction and having a first portion coupled to the foot rest at opposite ends of the foot rest and having a second portion disposed outside of the foot rest and defining a continuous and closed loop with the first portion of the stretchable member.

10. A method of providing exercise to a user, including the steps of:

providing an exercise unit including a foot rest and a stretchable member having a one-piece construction and coupled to the foot rest and extending in a continuous and closed loop from the opposite ends of the foot rest, disposing the feet of the user on the foot rest and enveloping the stretchable member on a selective portion of the user's body, and flexing the user's body at a selective one of the knees and hips alternatively in one direction and then in an opposite direction to stretch the stretchable member and then relieve the stress on the stretchable member, wherein the stretchable member constitutes the only element which stretches and contracts in accordance with the exercising operation of the unit by the user.

11. A method of providing exercise to a user, including the steps of:

providing an exercise unit including a foot rest and a stretchable member coupled to the foot rest and extending in a continuous and closed loop from the opposite ends of the foot rest, disposing the foot rest on a support surface, disposing the feet of the user on the foot rest with the foot rest on the support surface and enveloping the stretchable member on a selective portion of the user's body, and flexing the user's body at a selective one of the knees and hips, with the foot rest on the support surface, alternately in one direction and then in an opposite direction to stretch the stretchable member and then relieve the stress on the stretchable member wherein the foot rest is made from a non-stretchable material.

12. In combination in an exercise unit, a foot rest, and a stretchable member having a one-piece construction and having a first portion coupled to the foot rest at opposite ends of the foot rest and having a second portion disposed outside of the foot rest and defining a continuous and closed loop with the first portion of the stretchable member, the foot rest having an aperture which extends through the foot rest and a hollow rod extending through the aperture and the stretchable member having a portion extending through the hollow rod and having another portion disposed outside of the hollow rod and defining a continuous and closed loop with the portion extending through the hollow rod.

13. In a combination as set forth in claim 12, the foot rest having a tear drop configuration in section to facilitate the disposition of the feet of the user on the foot rest with the knees of the user bent, the tear drop configuration being defined by a thick end, the aperture being disposed at the thick end of the tear drop configuration of the foot rest.

14. A method of providing exercise to a user, including the steps of:

providing an exercise unit including a foot rest and a stretchable member coupled to the foot rest and extending in a closed loop through the foot rest and outside of the foot rest, disposing the feet of the user on the foot rest and enveloping the stretchable member on a selective portion of the user's body, and flexing the user's body at a selective one of the knees and hips alternately in one direction and then in an opposite direction to stretch the stretchable member and then relieve the stress on the stretchable member wherein the foot rest is made from a non-stretchable material and wherein the stretchable member is the only stretchable element in the exercise unit and wherein the foot rest has an aperture extending through the foot rest and wherein a hollow rod extends through the foot rest and wherein the stretchable member has a first portion extending through the rod and a second portion disposed outside of the rod and defining a closed loop with the first portion.

15. A method of providing exercise to a user, including the steps of:

providing a foot rest and a stretchable member coupled to the foot rest in a closed loop, disposing the feet of the user on the foot rest and enveloping the stretchable member on a selective portion of the user's body, and flexing the user's body at a selective one of the knees and hips alternately in one direction and then in an opposite direction alternately to stretch the stretchable member and then relieve the stress on the stretchable member, wherein the foot rest has an aperture extending through the foot rest and wherein a hollow rod extends through the foot rest and wherein the stretchable member has a first portion extending through the rod and a second portion disposed outside of the rod and defining a closed loop with the first portion, the foot rest has a tear drop configuration in section to facilitate the disposition of the feet of the user on the foot rest with the knees of the user bent and wherein the tear drop configuration of the foot rest defines a thick end in the foot rest, the aperture is disposed at the thick end of the tear drop configuration of the foot rest.

16. In a combination as set forth in claim 14 wherein the stretchable member constitutes a single element defining a continuous and closed loop with a portion of the single element within the hollow rod and the remaining portion of the single element outside of the rod.

17. In a combination as set forth in claim 16 wherein the single element is the only stretchable element in the exercise unit.

18. In a combination as set forth in claim 17 wherein the foot rest is non-stretchable.

19. In combination in an exercise unit, a foot rest for supporting the feet of the user, an aperture in the foot rest, a hollow rod extending through the aperture, stretchable means extending through the rod to define a closed loop for the production of a constraint on the stretchable means when the stretchable means is stretched the stretchable means being disposed around a portion of the user's body to become constrained, and to become relieved of the constraint, by the alternate adoption by the user of first and second positions of the user's body, wherein the stretchable member constitutes a single member defining a closed loop with a portion of the single member within the hollow rod and the remaining portion of the single member outside of the rod, wherein the single member is the only stretchable member in the exercise unit and wherein the foot rest has a tear drop configuration with a thick end and wherein the aperture is disposed at the thick end of the tear drop configuration of the foot rest.

* * * * *